US007237604B2

(12) United States Patent
Emrich et al.

(10) Patent No.: US 7,237,604 B2
(45) Date of Patent: Jul. 3, 2007

(54) STACKED PLATE HEAT EXCHANGER

(75) Inventors: Karsten Emrich, Stuttgart (DE); Daniel Hendrix, Stuttgart (DE); Joachim Kopp, Stuttgart (DE); Wolfgang Kramer, Weinstadt (DE); Florian Moldovan, Stuttgart (DE); Jens Richter, Ludwigsburg (DE)

(73) Assignee: Behr GmbH & Co. KG, Stuttgart (DE)

( * ) Notice: Subject to any disclaimer, the term of this patent is extended or adjusted under 35 U.S.C. 154(b) by 132 days.

(21) Appl. No.: 10/530,761

(22) PCT Filed: Sep. 1, 2003

(86) PCT No.: PCT/EP03/09675

§ 371 (c)(1),
(2), (4) Date: Apr. 8, 2005

(87) PCT Pub. No.: WO2004/036134

PCT Pub. Date: Apr. 29, 2004

(65) Prior Publication Data

US 2006/0011333 A1 Jan. 19, 2006

(30) Foreign Application Priority Data

Oct. 10, 2002 (DE) ..... 102 47 264

(51) Int. Cl.
*F28F 9/02* (2006.01)

(52) U.S. Cl. ..... 165/167; 165/158

(58) Field of Classification Search ..... 165/157, 165/158, 166, 167

See application file for complete search history.

(56) References Cited

U.S. PATENT DOCUMENTS

| | | | | |
|---|---|---|---|---|
| 4,846,268 | A * | 7/1989 | Beldam et al. | 165/153 |
| 5,931,219 | A | 8/1999 | Kull et al. | |
| 2002/0029872 | A1 * | 3/2002 | Jamison et al. | 165/153 |

FOREIGN PATENT DOCUMENTS

| | | | |
|---|---|---|---|
| DE | 43 14 808 | A1 | 11/1994 |
| DE | 195 11 991 | A1 | 10/1996 |
| DE | 100 24 389 | A1 | 11/2000 |
| EP | 0 984 239 | A2 | 3/2000 |
| JP | 7-159074 | * | 6/1995 |
| JP | 7-159076 | * | 6/1995 |
| JP | 7-159076 | A | 6/1995 |
| JP | 2000-204941 | A | 7/2000 |
| WO | WO 03/046461 | A1 | 6/2003 |

* cited by examiner

*Primary Examiner*—Teresa J. Walberg
(74) *Attorney, Agent, or Firm*—Foley & Lardner LLP

(57) ABSTRACT

A plate heat exchanger comprising a plurality of plates (12,13) which are stacked against each other and which are of a first and second type in order to form flow channels for a first and second medium. The plates form a heat exchanger block (2) with an upper side and a lower side and with two opposite side surfaces (10) and front faces (9). The first flow channels are peripherally sealed for the first medium and are fluidically connected to distributor and collector channels which are arranged in a vertical position with respect to the plate plane and which lead into inlet and outlet connection pieces (6,7) which are respectively arranged on the upper side and/or lower side (3,11). The second flow channels are open at the front surfaces (9) thereof and are sealed at the side surfaces (10) thereof. The open sides (9) form an inlet and outlet plane for the second medium.

19 Claims, 8 Drawing Sheets

STACKED PLATE HEAT EXCHANGER

Figure 1:
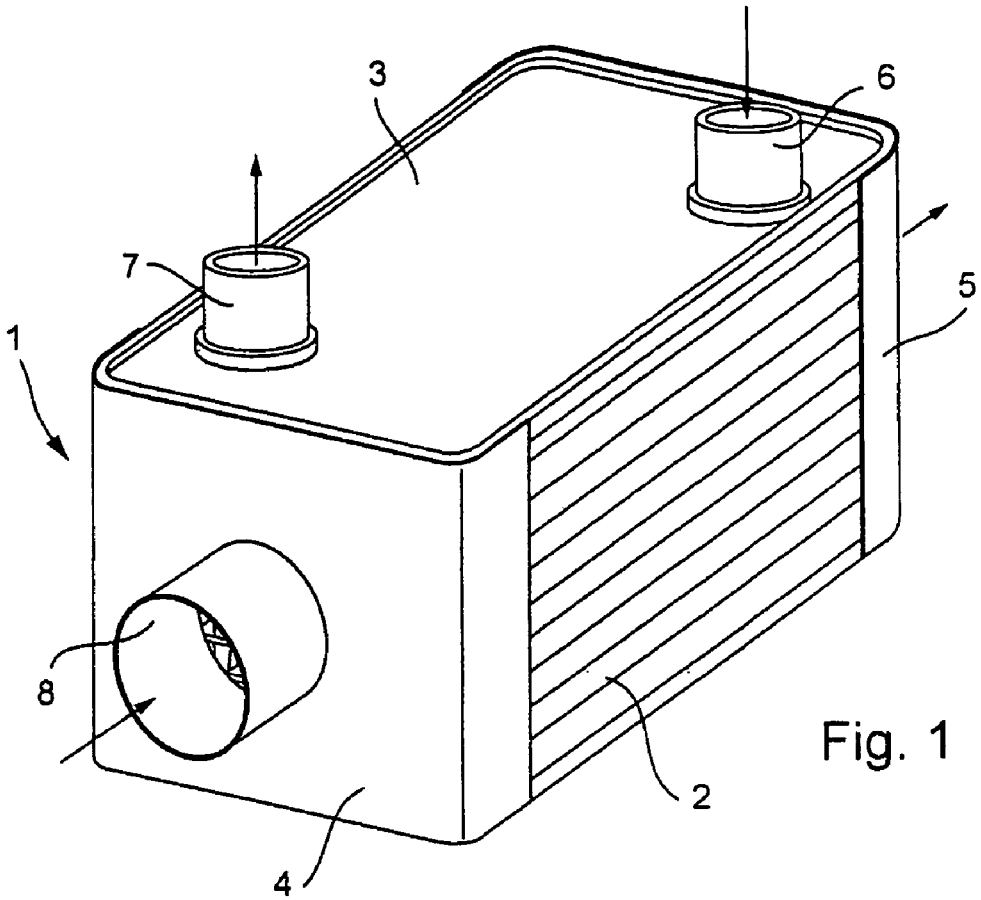

The invention relates to a stacked plate heat exchanger in accordance with the preamble of patent claim 1.

Stacked plate heat exchangers have been disclosed by DE-A 43 14 808 and DE-C 195 11 991 in the name of the present Applicant. This stacked design is cost-effective for heat exchangers in that a high number of identical parts of relatively simple configuration are used. According to DE-A 43 14 808, the heat exchanger can be produced using a single type of plate, which is in each case rotated through 180° during assembly and stacking. In the case of DE-C 195 11 991, one embodiment uses two different types of plates in order to achieve different passage heights. This is advantageous in particular if the heat exchanger has one liquid and one gaseous medium flowing through it, for example coolant and charge air in an internal combustion engine. In this stacked plate heat exchanger, the connection pieces for the charge air and the coolant are either all arranged on one side, for example on the top side, or are arranged on two sides, i.e. the top side and the underside of the heat exchanger. The inlet and outlet connection pieces are generally aligned with distribution and collection passages within the heat exchanger block, and the heat-transfer media flow transversely with respect to the distribution and collection passages through flow passages between the stacked plates or heat exchanger plates. This results in a double 90° diversion for both media, which causes the pressure drop in the heat exchanger to increase. A pressure drop of this nature is undesirable in particular for the routing of the charge air.

Therefore, it is an object of the present invention to improve a stacked heat exchanger of the type described in the introduction in such a way that the pressure drop is reduced at least for one medium.

This object is achieved by the features of patent claim 1. According to the invention, one medium, i.e. for example the charge air or the exhaust gas, is no longer diverted through 90°, but rather the gaseous medium flows through the heat exchanger directly in the longitudinal direction. This is achieved, in a modification to the standard stacked arrangement, by the plates which are stacked on top of one another only being closed off at two opposite sides, but being open at the two end sides. The plates for the other medium, i.e. for example the coolant, on the other hand, are closed at the periphery—as has hitherto been customary—and connected to in each case a distribution passage and a collection passage. A further advantage is that the inexpensive stacked design can be maintained yet at the same time the pressure drop for a gaseous medium is reduced.

Advantageous configurations of the invention will emerge from the subclaims.

According to an advantageous refinement of the invention, inlet and outlet boxes with inlet and outlet connection pieces are fitted onto the end faces of the heat exchanger block, with the connection pieces arranged aligned with one another. This results in a particularly low pressure drop for the gaseous medium, e.g. charge air, exhaust gas. If the installation conditions require, the inlet or outlet connection piece may also be connected to the inlet or outlet box at a predeterminable angle of up to 90°. The boxes may advantageously be formed from a bent metal plate and two end plates which project beyond the end faces. This enables the all-metal design, for example comprising steel or aluminum, to be maintained for this heat exchanger, which can therefore be soldered in full "in one go" in the soldering furnace. However, the inlet and outlet boxes may also be designed as independent structural units and can be joined to the heat exchanger block independently of the soldering operation, in particular after the soldering operation, for example by welding or adhesive bonding.

According to a further advantageous configuration of the invention, the flow passages for the first medium, e.g. the coolant, are closed at the periphery, specifically by a surrounding edge with a surrounding fold which is soldered to an adjacent plate. Consequently, the flow of coolant is hermetically sealed off from the second medium, for example with respect to the charge air or exhaust gas. The flow passages for the second medium are directly adjacent to the flow passages for the coolant, but the charge air flow passages are largely open at the two end sides of the heat exchanger block. To increase the heat transfer capacity, metal turbulence plates, which are soldered to the adjacent plates and therefore increase the strength of the heat exchanger block, may be arranged in the flow passages for the charge air or exhaust gas. Metal turbulence plates may also be arranged in a similar way in the flow passages for the coolant.

According to an advantageous refinement of the invention, the distribution and collection passages for the coolant are formed by cup-like stamped formations in both plates. The stamped formations bear against one another and are soldered together in the region of their contact surfaces, resulting in continuous passages for the coolant. Alternatives, such as intermediate rings or sleeves or passage sections fitted into one another, are also possible.

In another embodiment, the cup-like stamped formations are formed outside the heat exchanger block, allowing better routing of the second medium within the heat exchanger block.

In an advantageous configuration of the invention, the flow passages for the charge air are formed by a special type of plate, which has lateral flanged edges. These flanged edges are angled either once to form an L section or twice to form a C section and thereby form bearing surfaces with the respectively adjacent plates. The plates are soldered to one another in the region of these bearing or contact surfaces and thereby form the flow passages for the charge air which are closed off with respect to the outside, i.e. also form the lateral terminating walls of the heat exchanger block.

Figure 2:
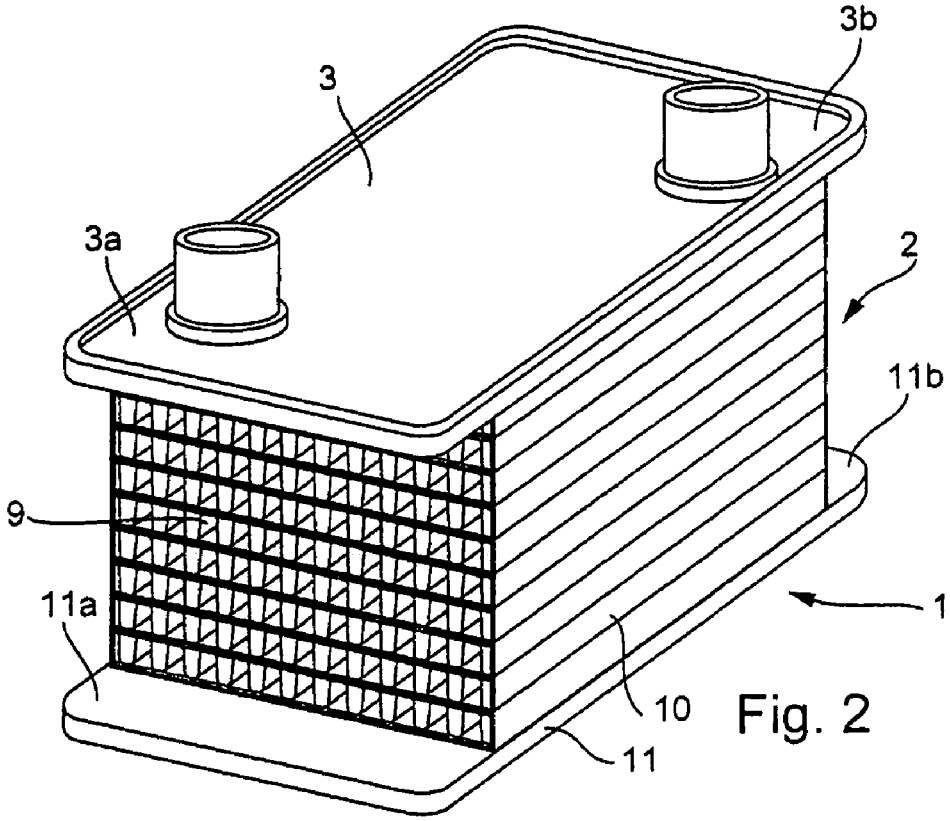
Figure 3:
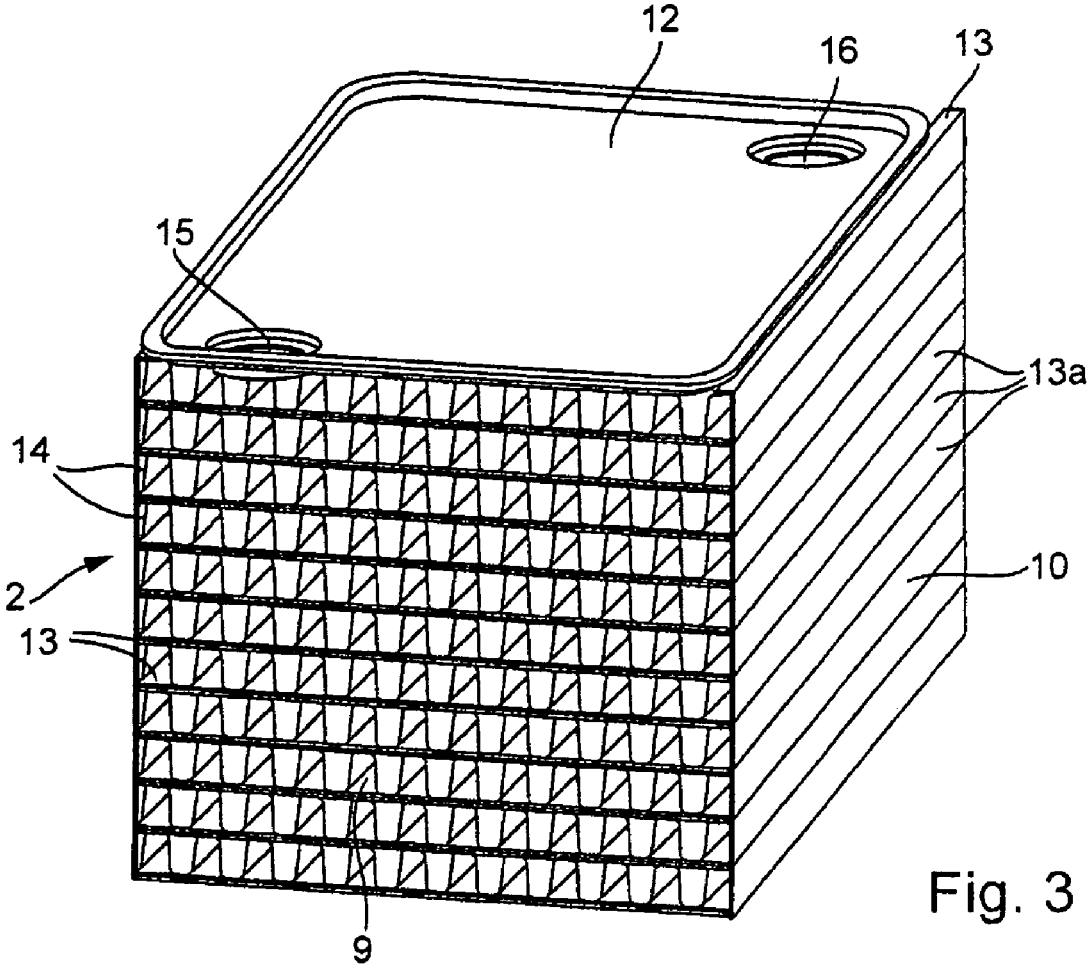
Figure 4:
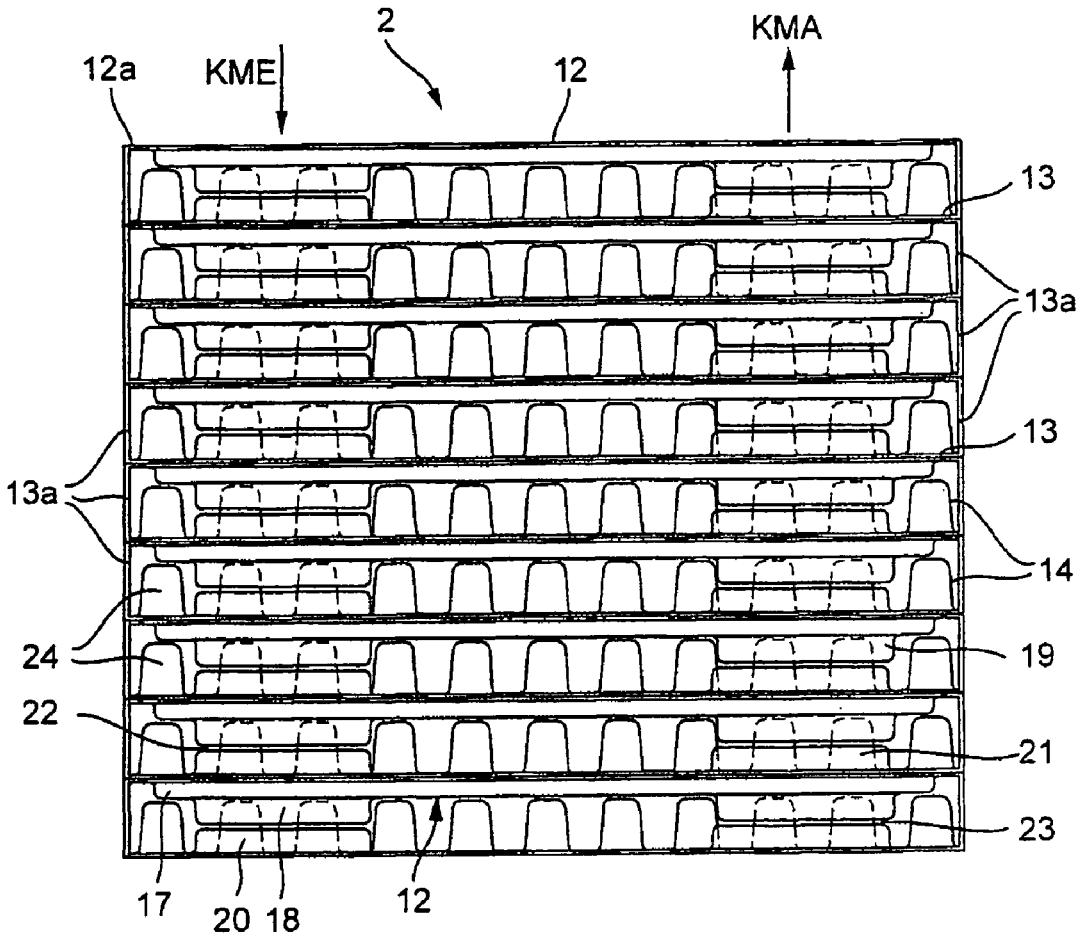
Figure 5:
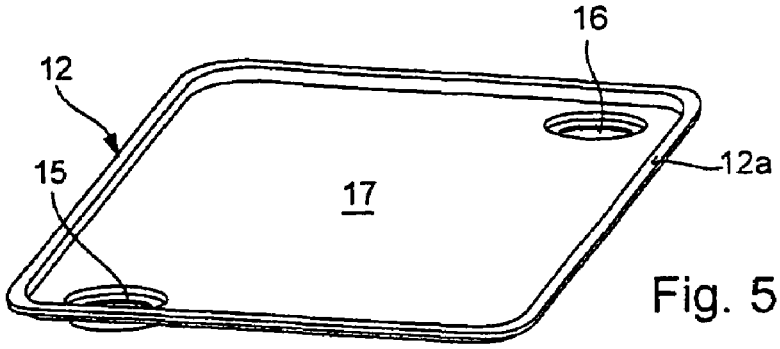
Figure 5A:
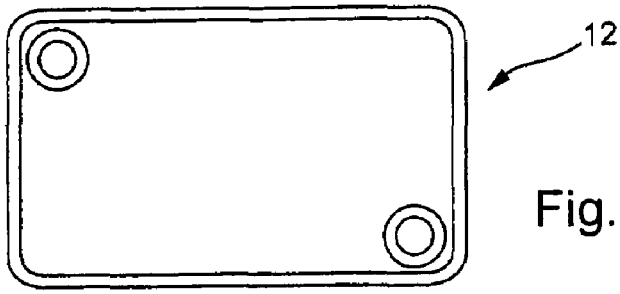
Figure 6:
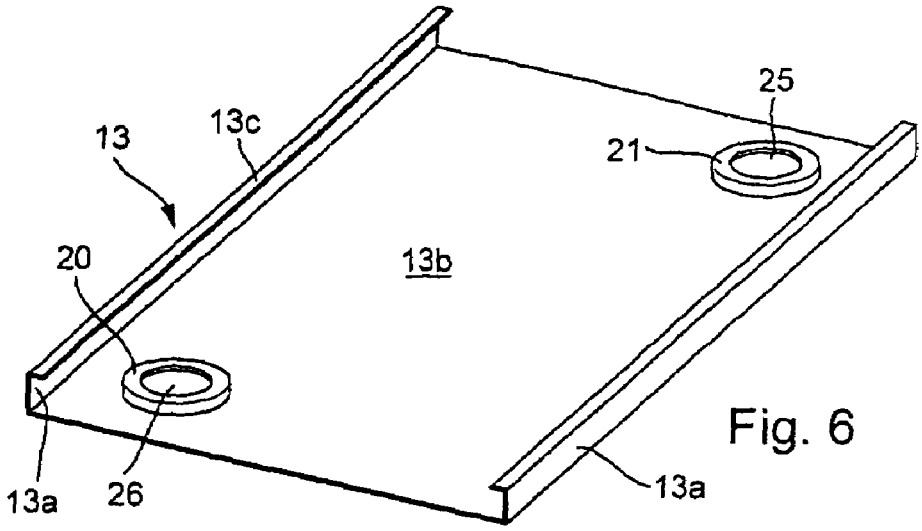
Figure 7:
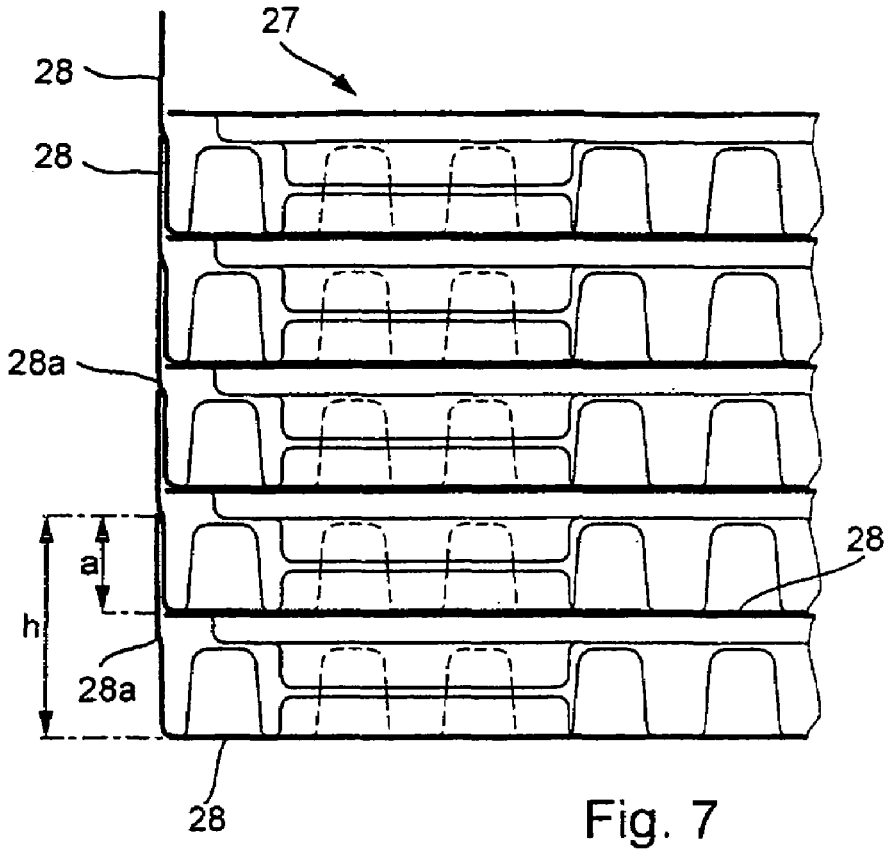
Figure 8:
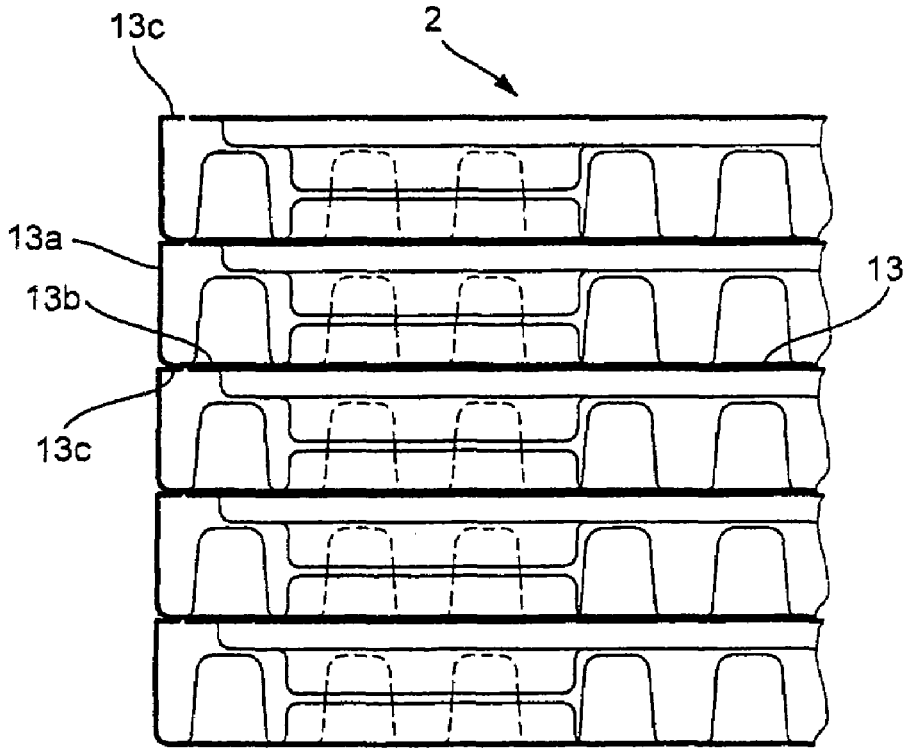
Figure 9:
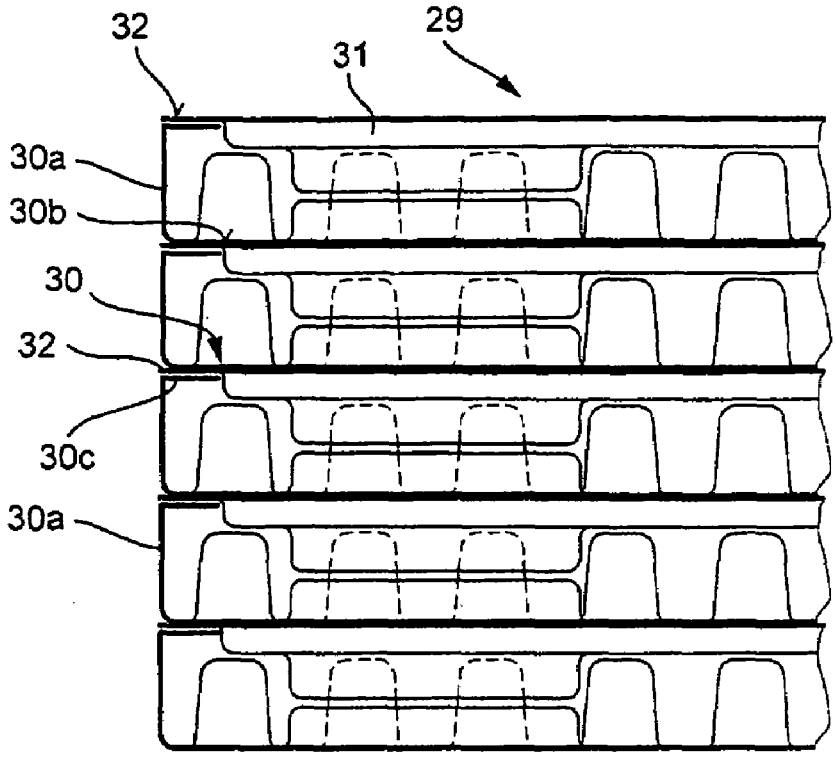
Figure 10:
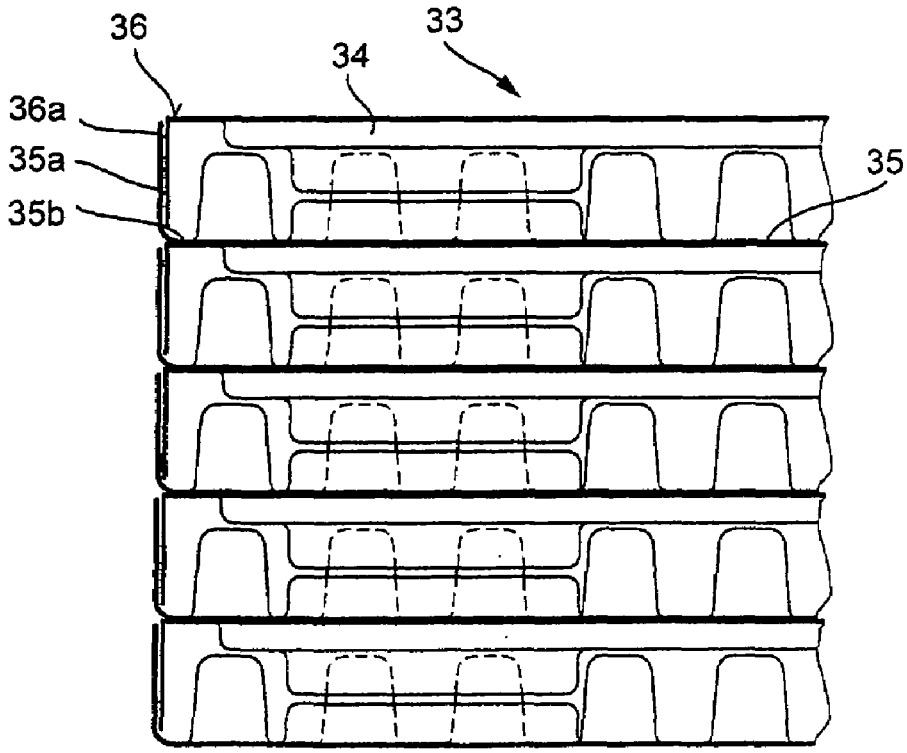
Figure 11:
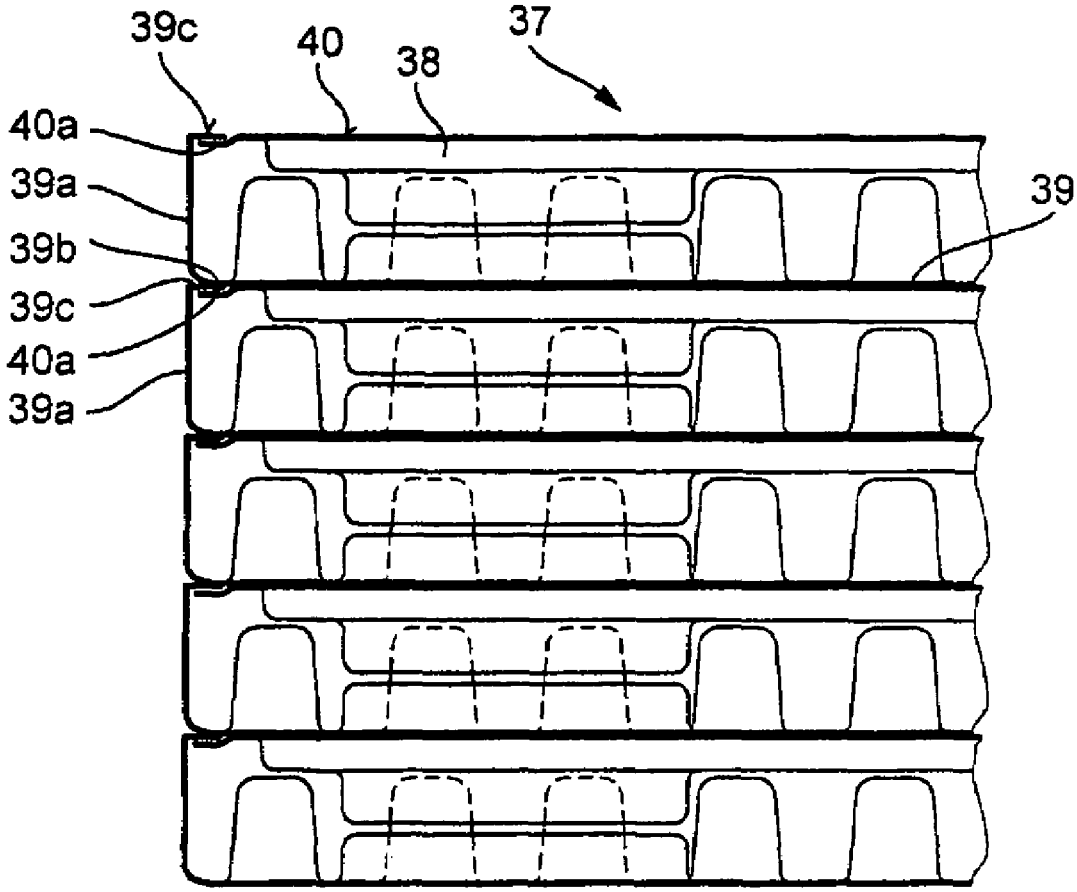

Exemplary embodiments of the invention are illustrated in the drawings and described in more detail in the text which follows. In the drawings:

FIG. 1 shows a charge air/coolant cooler,

FIG. 2 shows the charge air/coolant cooler shown in FIG. 1 without the air boxes, FIG. 3 shows a perspective illustration of the heat exchanger block of the charge air/coolant cooler shown in FIG. 1 and FIG. 2, FIG. 4 shows a front view of the heat exchanger block shown in FIG. 3, FIG. 5, 5*a, b, c* show various views of a first type of plate (coolant plate), FIG. 6, 6*a*, 6*b* show various views of a second type of plate (charge air plate), FIG. 7 shows an excerpt from a first modification of the heat exchanger block, FIG. 8 shows an excerpt from a second modification of the heat exchanger block, FIG. 9 shows an excerpt from a third modification of the heat exchanger block, FIG. 10 shows an excerpt from a fourth modification of the heat exchanger block, and FIG. 11 shows an excerpt from a fifth modification of the heat exchanger block.

FIG. 1 shows a stacked charge air/coolant cooler 1 for an internal combustion engine of a motor vehicle having a coolant and charge air circuit (not shown). The core of the charge air/coolant cooler 1 is a heat exchanger block 2, which is closed off at the top by a termination plate 3 and at the end sides by air boxes 4, 5. The heat exchanger block 2 on the one hand has coolant flowing through it, this coolant entering through a coolant inlet connection piece 6 arranged on the top side 3 and emerging again through a coolant connection piece 7 likewise arranged on the top side 3. The charge air (which has been heated by a compressor that is not shown) enters the charge air/coolant cooler 1 via an inlet connection piece 8 arranged centrally on the air box 4 and leaves the charge air/coolant cooler 1, after having been cooled, through an outlet connection piece, which is not visible but is arranged aligned with the inlet connection piece 8 at the outlet box 5.

FIG. 2 shows the charge air/coolant cooler 1 without the air boxes 4 and 5 in accordance with FIG. 1. The heat exchanger block 2 has an open end face 9 and a closed side face 10 and is covered at the top by the termination plate 3 and at the bottom by a termination plate 11. A region 3*a* of the upper plate 3 and a region 11*a* of the lower plate 11 project beyond the end face 9. These two regions 3*a*, 11*a* therefore form the side faces of the air box 4 (FIG. 1), which has been bent from a metal sheet. The plates 3, 11 project in a similar way beyond the rear end face (not visible) of the heat exchanger block 2, specifically by means of regions 3*b*, 11*b*. The air box 5 (FIG. 1) is therefore of similar design to the air box 4.

FIG. 3 shows a perspective illustration of the heat exchanger block 2, which is constructed from two different types of plates stacked on top of one another, together with turbulence inlays. The first type of plate is what is known as a coolant plate 12, and the second type of plate is what is known as a charge air plate 13. The coolant plate 12 has two circular openings 15, 16 (both plates are described in more detail in connection with FIG. 5 and FIG. 6). Metal turbulence plates 14 for the charge air, which enters the heat exchanger block 2 via the open end side 9, are arranged between the two plates 12, 13. The heat exchanger block 2 has a closed side face 10, which is formed by flanged edges 13*a* of the charge air plates 13. The opposite side face (not visible in this illustration) is of similar design.

FIG. 4 shows a front view of the heat exchanger block 2, i.e. a view onto the end face 9 and in the direction of flow of the charge air. The heat exchanger block 2 is therefore constructed from the coolant plates 12 and the charge air plates 13, which are stacked alternately on top of one another. The coolant plate 12 has a well-like recess 17, from which two cup-like elevations 18, 19, with the openings 15, 16 in the interior (cf. FIG. 3), are stamped. As seen in the drawing, the coolant plate 12 is closed off at the top by a planar, surrounding fold 12*a*. The charge air plate 13 bears against this fold 12*a* and therefore forms a surrounding contact surface with the fold 12*a* in order for the two plates 12, 13 to be soldered together in this region. The charge air plate 13 in each case extends laterally beyond the fold 12*a*, where it has flanged edges 13*a* in the form of a C section on both sides. The upper and lower (horizontal in the plane of the drawing) limbs of the C section in each case form contact surfaces with the lower and upper limbs, respectively, of the adjacent C sections, in order for them to be soldered together. Corresponding, oppositely directed stamped formations 20, 21 are arranged at the charge air plates 13 aligned with the cup-shaped stamped formations 18, 19 of the coolant plates 12, so that when the plates 12, 13 are stacked stamped formations 18, 20 and 19, 21 in each case come to bear against one another, thereby forming a distribution passage 22, which extends continuously from the top downward, and a collection passage 23 for the coolant. Coolant inlet and coolant outlet are denoted by arrows bearing the designations KME and KMA. The flow passages for the coolant therefore correspond to the well-like recesses 17, in which metal turbulence plates (not shown) are also arranged. Turbulence inlays 14 are arranged between in each case one coolant plate 12, i.e. the air side thereof, and an adjacent charge air plate 13, these turbulence inlays thereby forming part of the flow passages 24 for the charge air. As has already been mentioned, the charge air enters the heat exchanger block 2 perpendicular to the plane of the drawing and flows through it in a straight direction, apart from the diversions caused by the cup-like stamped formations 18 to 21.

Figure 5B:
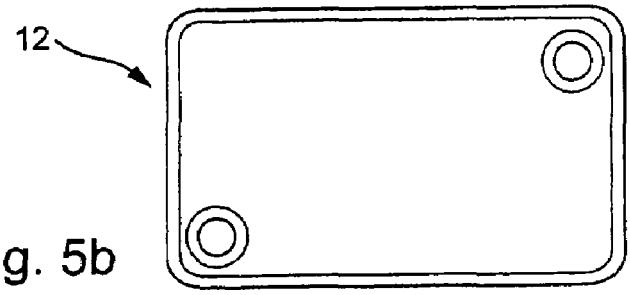
Figure 5C:
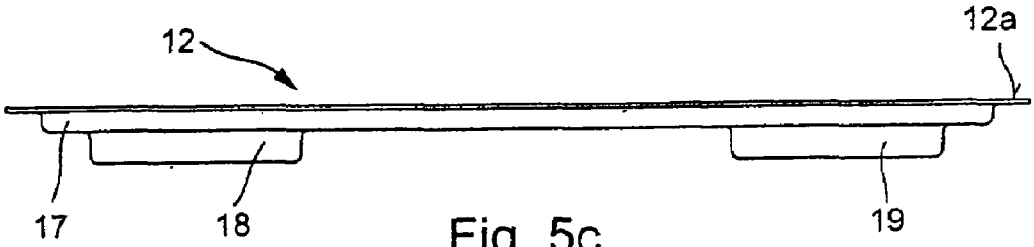

FIG. 5, 5*a* to 5*c* show various views of the coolant plate 12. FIGS. 5, 5*a* and 5*b* show the rectangular plate 12, which is rounded at the corners and has two openings 15, 16 that are arranged diagonally opposite one another and are stamped out of the plate. The plate 12 is deep-drawn and includes the recess 17 (cf. FIG. 5*c*), the upper edge of which merges into the encircling fold 12*a*. In the region of the openings 15 and 16, the recess 17 is adjoined by the cup-like stamped formations 18, 19. Although the illustration only shows rectangular plates 12, it is, however, also conceivable to use other geometric shapes, in particular if the cup-like stamped formations are arranged outside the main direction of flow.

Figure 6A:
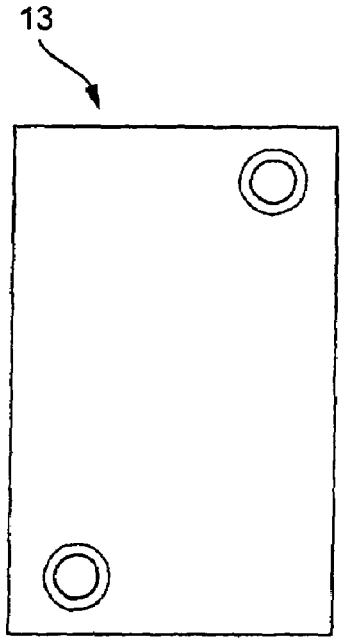
Figure 6B:
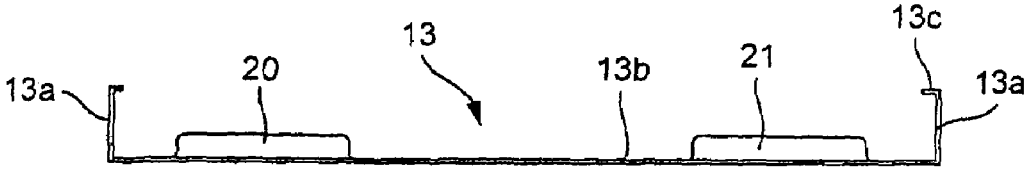

FIG. 6, FIG. 6*a* and FIG. 6*b* show various views of the charge air plate 13, once again using the same reference numerals as above. The basic contour (FIG. 6*a*) of the charge air plate 13 corresponds to that of the coolant plate 12, except that the charge air plate 13 is slightly wider in the direction of the flanged edges 13*a*. The charge air plate 13 has a planar part 13*b*, the size of which is at least sufficient for it to cover the fold 12*a* of the coolant plate 12. The flanged edges 13*a* form a C section with a vertical surface 13*a* and a horizontal surface 13*c*. In the stacked arrangement shown in FIG. 4, the latter bears against the underside 13*b* of the adjacent charge air plate 13. The two cup-like stamped formations 20, 21 with stamped-out openings 25, 26 are formed out of the planar part 13*b* of the charge air plate 13, and the position of these stamped formations and openings corresponds to the stamped formations 18, 19 and openings 15, 16 of the coolant plate 12.

FIG. 7 shows an excerpt from a modified embodiment of a heat exchanger block 27 with modified charge air plates 28. The latter have a flanged edge or vertically positioned rim 28*a* the height h of which is such that an overlap a with the adjacent charge air plate 28 is produced, thereby creating a contact surface for the soldering.

FIG. 8 shows an enlarged excerpt from the heat exchanger block 2 from FIG. 4 with the charge air plate 13 and the double flanged edge 13*a*, 13*c* forming a C section. This charge air plate 13 is illustrated as an individual part in FIG. 6. The present figure shows how the upper limb 13*c* of the C section bears against the underside of the planar part 13*b* of the charge air plate 13 and thereby forms a soldering surface.

FIG. 9 shows a further modification of a heat exchanger block 29 having a charge air plate 30 and a modified coolant plate 31, the fold 32 of which is extended toward the outside. The charge air plate 31—as also illustrated in FIG. 6—has a C-shaped edge section 30*a*, 30*c*, so that the extended fold 32 comes to bear against the limb 30*c* of the C section, thereby forming a soldering surface. The planar part 30*b* of the charge air plate 30 bears against the fold 32.

FIG. 10 shows a further modification of a heat exchanger block 33 with a modified coolant plate 34 and a charge air plate 35 with a vertical angled section 35*a*. The coolant plate 34 has an outwardly extended flange part 36 which is angled off downward to form a vertical flanged edge surface 36*a*. The two surfaces 35*a* of the charge air plate 35 and 36*a* of the coolant plate 34 bear against one another and thereby form a soldering surface for forming a closed flow passage for the charge air.

FIG. 11 shows a further modification of a heat exchanger block 37 with a modified coolant plate 38 and a charge air plate 39 which once again has a C-shaped flanged edge section 39*a*, 39*c*. The coolant plate 38 has a surrounding fold 40, which is adjoined by a strip 40*a* that is offset downward via a shoulder. This strip 40*a* bears against the underside of the limb 39*c* of the C section of the charge air plate 39 and thereby forms a soldering surface. The planar part 39*b* of the charge air plate 39 bears against the top side of the limb 39*c*, so that in this region three wall thicknesses are positioned above one another.

The invention claimed is:

1. A stacked plate heat exchanger, comprising a multiplicity of plates of a first type and a second type stacked on top of one another so as to form first flow passages for a first medium and second flow passages for a second medium, wherein pairs formed by one first type and one adjacent second type of plates define between them said first flow passage, and adjacent pairs of plates form between the adjacent pairs said second flow passages, the stack of plates forming a heat exchanger block having a top side and an underside and having in each case two opposite side faces and opposite end faces, wherein the first flow passages for the first medium are closed at their peripheral sides and are in fluid communication with distribution and collection passages, which are arranged perpendicular to the plane of the plates and respectively open out into inlet and outlet connection pieces arranged on the top side and/or underside of the heat exchanger block, wherein the second flow passages are designed to be largely open at the end faces such that the open sides form an inlet plane and an outlet plane for the second medium, and wherein the second type of plates have lateral flanged edges which are bent at a right angle with respect to the plane of the second type plate in a direction away from its respectively paired first type plate and toward the adjacent pair of plates, and in the bent portion of the lateral flanged edge contains a solder surface adapted to be soldered to at least one of the first type or second type plate of the adjacent pair of plates, to close off the second flow passages at the side faces with respect to the outside and form the side faces of the heat exchanger block.

2. The plate heat exchanger as claimed in claim 1, further comprising an inlet box and an outlet box for the second medium connected to the end faces.

3. The plate heat exchanger as claimed in claim 2, wherein the inlet and outlet boxes are each designed as independent structural units joined to the heat exchanger block.

4. The plate heat exchanger as claimed in claim 2, wherein the inlet and outlet boxes have inlet and outlet connection pieces that aligned with one another.

5. The plate heat exchanger as claimed in claim 2, wherein at the inlet and outlet boxes the inlet and outlet connection pieces are arranged at a predeterminable angle of up to 90° with respect to the main direction of flow.

6. The plate heat exchanger as claimed in claim 1, wherein the inlet and/or outlet boxes are formed by bent sheet-metal strips and cover plates which protrude beyond the end faces.

7. The plate heat exchanger as claimed in claim 1, wherein the first type of plate has a recess with a surrounding flat fold in the second type of plate has a planar region (13*b*) covering the fold, and each pair of the first and second types of plates are joined to one another in the region of the fold and between them enclose the first flow passage for the first medium.

8. The plate heat exchanger as claimed in claim 1, wherein the distribution and collection passages are formed by passage sections which are arranged between the respective plates of each pair of plates and connect the plates of each pair together.

9. The plate heat exchanger as claimed in claim 1, wherein the passage sections are designed as cup-like elevations and are shaped out of the plates.

10. The plate heat exchanger as claimed in claim 9, wherein the cup-like elevations are arranged outside the main direction of flow.

11. The plate heat exchanger as claimed in claim 1, further comprising metal turbulence plates arranged in the first and/or second flow passages.

12. The plate heat exchanger as claimed in claim 1, wherein the flanged edges form an overlap with the flanged edge of the second type of plate in the adjacent pair of plates.

13. The plate heat exchanger as claimed in claim 1, wherein the flanged edges are angled twice and form a C section which bears against a second type of plate in the adjacent pair of plates.

14. The plate heat exchanger as claimed in claim 1, wherein the flanged edges form a C section which bears against the first type of plate in the adjacent pair of plates.

15. The plate heat exchanger as claimed in claim 1, wherein the first type of plates have lateral flanged edges, and the flanged edges of the first and second types of plates are oppositely directed and are arranged so as to bear against one another.

16. The plate heat exchanger as claimed in claim 1, wherein the flanged edge is angled twice and forms a C section with a free limb which on one side bears against the first type of plate and on the other side bears against the second type of plate in the adjacent pair of plates.

17. A charge air/coolant cooler having the plate heat exchanger as claimed in claim 1.

18. An exhaust gas/coolant cooler having the plate heat exchanger as claimed in claim 1.

19. A stacked plate heat exchanger as claimed in claim 1, wherein the side faces are generally planar.

* * * * *